US007494959B2

(12) United States Patent
Olliges

(10) Patent No.: US 7,494,959 B2
(45) Date of Patent: Feb. 24, 2009

(54) MULTI-PHASE LUBRICANT COMPOSITIONS CONTAINING EMULSIFIED BORIC ACID

(75) Inventor: William E. Olliges, Palm City, FL (US)

(73) Assignee: Advanced Lubrication Technology Inc., Agoura Hills, CA (US)

( * ) Notice: Subject to any disclaimer, the term of this patent is extended or adjusted under 35 U.S.C. 154(b) by 365 days.

(21) Appl. No.: 11/201,942

(22) Filed: Aug. 10, 2005

(65) Prior Publication Data

US 2007/0037714 A1 Feb. 15, 2007

(51) Int. Cl.
*C10M 125/26* (2006.01)

(52) U.S. Cl. ..... 508/160; 508/156; 508/158; 508/208; 508/579; 508/583

(58) Field of Classification Search ..... 508/156, 508/160
See application file for complete search history.

(56) References Cited

U.S. PATENT DOCUMENTS

| | | | | | |
|---|---|---|---|---|---|
| 2,614,985 | A | * | 10/1952 | Cook | 508/156 |
| 2,987,476 | A | | 6/1961 | Whitbey et al. | |
| 3,002,826 | A | | 10/1961 | Norris | |
| 3,829,381 | A | | 8/1974 | Le Suer | |
| 3,907,691 | A | | 9/1975 | King et al. | |
| 3,997,454 | A | | 12/1976 | Adams | |
| 4,298,482 | A | | 11/1981 | Cheng et al. | |
| 4,448,701 | A | * | 5/1984 | Duerksen et al. | 508/160 |
| 4,626,367 | A | * | 12/1986 | Kuwamoto et al. | 508/156 |
| 4,636,326 | A | | 1/1987 | Hernandez et al. | |
| 4,690,687 | A | | 9/1987 | Johnston | |
| 4,846,985 | A | | 7/1989 | Rizvi | |
| 5,431,830 | A | | 7/1995 | Erdemir | |
| 5,512,198 | A | * | 4/1996 | Sasaki et al. | 252/68 |
| 5,739,088 | A | * | 4/1998 | Inoue et al. | 508/156 |
| 5,877,129 | A | * | 3/1999 | Yatsuzuka et al. | 508/156 |
| 6,025,306 | A | | 2/2000 | Erdemir | |
| 6,245,723 | B1 | | 6/2001 | Sigg | |
| 6,368,369 | B1 | | 4/2002 | Sanduja et al. | |
| 6,472,352 | B1 | * | 10/2002 | Hacias | 508/155 |
| 6,645,262 | B1 | | 11/2003 | Sandiya et al. | |
| 6,783,561 | B2 | | 8/2004 | Erdemir | |
| 2003/0045435 | A1 | | 3/2003 | Erdemir | |
| 2004/0093789 | A1 | | 5/2004 | Hart et al. | |
| 2005/0009712 | A1 | | 1/2005 | Erdemir | |
| 2007/0033862 | A1 | | 2/2007 | Olliges | |
| 2007/0037714 | A1 | | 2/2007 | Olliges | |

FOREIGN PATENT DOCUMENTS

| | | | | |
|---|---|---|---|---|
| DE | 19703085 | A1 | | 7/1998 |
| EP | 0206833 | | | 12/1986 |
| EP | 207560 | A1 | * | 1/1987 |
| EP | 0288296 | A1 | | 10/1988 |
| EP | 0403205 | A | | 12/1990 |
| FR | 1559468 | | | 3/1969 |
| FR | 2277881 | | * | 2/1976 |
| GB | 434109 | A | | 8/1935 |
| GB | 943777 | | | 12/1963 |
| GB | 964184 | | | 7/1964 |
| GB | 1169667 | A | | 11/1969 |
| GB | 1202386 | A | | 8/1970 |
| GB | 1307127 | | * | 2/1973 |
| GB | 2091291 | A | * | 7/1982 |
| GB | 2173419 | | | 10/1986 |
| WO | 8701126 | | | 2/1987 |

OTHER PUBLICATIONS

Abstract of WO 87/01126.
Jackson, M. M., et al., "Study of Diesel and Ethanol Blends Stability," SAE International, 2003.

* cited by examiner

*Primary Examiner*—Ellen M. McAvoy
(74) *Attorney, Agent, or Firm*—Cahn & Samuels, LLP

(57) ABSTRACT

Disclosed is a multiphase lubricant composition formed of an emulsion containing (a) a lubricant first phase, (b) a second phase formed of boric acid and a liquid that is a solvent for boric acid, but immiscible in the first phase, such as glycerol, and (c) a surfactant.

23 Claims, No Drawings

MULTI-PHASE LUBRICANT COMPOSITIONS CONTAINING EMULSIFIED BORIC ACID

BACKGROUND OF THE INVENTION

1. Field of the Invention

This invention relates to the chemical arts. In particular, this invention relates to lubricants, such as engine oils, hydraulic fluids, transmission fluids, cutting oils, and synthetic oils, containing boric acid.

2. Discussion of the Related Art

Lubricants serve an important function in preserving machine components and extending machine operating lifetimes. Optimization of lubricant properties has remained a primary objective as vehicle engines and other machines are operated under more demanding and difficult conditions associated with increased efficiency and performance. Numerous additives have been developed, but much remains to be done to accommodate the increased demands now being made of lubricants.

Boric acid is environmentally safe, inexpensive, and has an unusual capacity to enhance the antifriction and antiwear properties of sliding metal surfaces. Boric acid is a crystalline compound, insoluble in most petroleum-based and synthetic lubricants. Various attempts have been made to form stable lubricant compositions containing boric acid. For example, U.S. Pat. No. 5,431,830, to Erdemir, discloses lubricant compositions containing boric acid particles in a mixture and/or suspension. However, it is a drawback of such compositions that it can be difficult first to incorporate the boric acid particles in the lubricant and then to form stable products.

Accordingly, there remains a need for stable boric acid containing lubricant compositions that provide increased efficiency and performance to engines and other machines. There remains further need for stable boric acid containing lubricant compositions that can be easily prepared. The invention meets these needs and provides related advantages as well.

SUMMARY OF THE INVENTION

Now, in accordance with the invention, there have been found stable boric acid-containing lubricant compositions which increase the efficiency and performance of engines and other machines. The multiphase lubricant compositions are formed of an emulsion containing (a) a first phase comprised of the lubricant, (b) a second phase containing boric acid and a liquid, such as an organic liquid, that is a solvent for boric acid, but immiscible in the first phase, and (c) a surfactant. The liquid can be an organic liquid, such as a lower alkyl polyol, preferably glycerol, ethyl acetate, acetone, and alcohols such as methanol, ethanol, 1-propanol, 2-methyl-1-propanol, and 3-methyl-1-butanol or an inorganic liquid, such as glacial acetic acid or water, with glycerol being preferred.

Representative lubricants include engine oils, hydraulic fluids, transmission fluids, cutting oils, and synthetic oils.

In some embodiments, the concentration of the first phase is from about 30 to about 70 wt. %, preferably from about 45 to about 55 wt. %, and the concentration of the second phase is from about 30 to about 70 wt. %, preferably from about 45 to about 55 wt. %, based on the weight of the lubricant composition. And in some embodiments, the second phase contains from about 10 to about 25 wt. %, boric acid, and from about 90 to about 75 wt. %, organic liquid, based on the weight of the second phase.

Typically, the final boric acid concentration in the lubricant composition will be in the range of from about 10 ppm to about 50,000 ppm and more preferably in the range of from about 30 ppm to about 5,000 ppm, based on the weight of the lubricant composition.

DESCRIPTION OF THE PREFERRED EMBODIMENTS

Particular embodiments of the invention are described below in considerable detail for the purpose of illustrating its principles and operation. However, various modifications may be made, and the scope of the invention is not limited to the exemplary embodiments described below.

The multiphase lubricant composition in accordance with the invention is formed of an emulsion containing (a) a lubricant first phase, (b) a second phase formed of boric acid and a liquid that is a solvent for boric acid, but immiscible in the first phase, such as glycerol, and (c) a surfactant.

Representative lubricants include low viscosity oils, such as spindle and turbine lubrication oils, medium viscosity oils, such as engine oils, and high viscosity oils, such as gear oils. Useful oils include hydrocarbon-based oils, such as petroleum-based oils, synthetic oils, and mineral oils. Other lubricants useful as the first phase include hydraulic fluids, transmission fluids, and cutting oils, as well as other suitable lubricants which do not react with boric acid, and mixtures thereof.

The boric acid useful in forming the second phase typically has a particle size of 100 microns or less, preferably of 65 microns or less. In more preferred embodiments, the boric acid has a particle size in the range of from about 0.1 to about 2.5 microns, still more preferably in the range of from about 0.5 to about 1 micron. The preferred boric acid particles are advantageously produced by the low temperature jet-milling of commercially available boric acid.

Suitable liquids that are solvent for boric acid but immiscible in the first phase, must be compatible with the lubricant and its use. The liquids can be either organic or inorganic. Representative organic liquids include lower alkyl polyols. Lower alkyl polyols useful in forming the second phase typically contain from three to seven carbon atoms and at least three hydroxyl groups. The preferred lower alkyl polyol is glycerol. Other suitable organic liquids include ethyl acetate, acetone, and alcohols such as methanol, ethanol, 1-propanol, 2-methyl-1-propanol, and 3-methyl-1-butanol. Suitable inorganic liquids include glacial acetic acid or water.

The amount of boric acid in the second phase is dependent on the solubility of the boric acid in the liquid. It is generally desirable to add sufficient boric acid to saturate the second phase. Typically, the second phase contains from about 10 to about 25 wt. %, boric acid and from about 90 to about 75 wt. %, organic liquid, based on the weight of the second phase.

Suitable surfactants for the inventive lubricant compositions include tristyrylphenol ethoxylates, for example Soprophor TS-10 (Rhone Poulenc S. A.) or BSU (Rhodia Geronazzo Spa), EO/PO/EO block copolymers, for example Pluronic F-108, Pluronic F-38, Pluronic P-105 (BASF Wyandotte Corp.) and/or sodium salts of sulfonated naphthalene-sulfonic acid-formaldehyde condensation products, for example Morwet D-425 (Witco Chem. Corp.) or Orotan SN (Rohm & Haas, France S. A.), lignosulfonates, PO/EO butanol copolymers, for example Atlox G-5000, block copolymers of polyhydroxystearic acid and polyalkylene glycols, for example Atlox 4912 or 4914 (Uniqema), or partially hydrolysed or fully hydrolysed polyvinyl acetate, for example Mowiol 18-88 or Mowiol 4-88 (Hoechst AG).

It is often most efficient to initially prepare a lubricant composition containing a relatively high concentration of the second phase in the lubricant. The amount of lubricant in such a concentrate is generally from about 30 to about 70 wt. %, preferably from about 45 to about 55 wt. %, based on the weight of the concentrate. The amount of the second phase in such a concentrate is generally from about 30 to about 70 wt. %, preferably from about 45 to about 55 wt. %, based on the weight of the concentrate. Such a concentrate contains the surfactant in an amount sufficient to stabilize the first and second phases, generally from about 0.5 to about 1.5 wt. %, based on the weight of the concentrate.

The concentrate can then be diluted with additional lubricant to obtain the final desired concentration. The concentration of boric acid in the finished lubricant composition will depend on the particular lubricant. In general, the preferred range is from about 0.5 to about 50 wt. %, more preferably from about 1 to about 15 wt. %, for greases from about 1 to about 50 wt. %, more preferably from about 1 to about 20 wt. %, based on the total weight of the composition.

The inventive lubricant compositions can also contain one or more conventional lubricant additives. For example, the lubricant compositions can be used in the formulation of high temperature ovens or in aluminum extrusion operations, together with selected lubricant additives. Suitable additives include, but are not limited to, antioxidants, metal inactivators, thickeners, anti-wear agents, and extreme pressure agents, as well as viscosity index improvers, dispersants, anti-emulsifying agents, color stabilizers, detergents, rust preventatives, and pour point depressants.

Representative antioxidants include, but are not limited to, phenate sulfides; phosphosulfurized terpenes; sulfurized esters; aromatic amines, such as phenyl-1-naphtylamine, phenyl-2-naphtylamine, diphenyl-p-phenylenediamine, dipyridylamine, phenothiazine, N-methylphenothiazine, N-ethylphenothiazine, 3,7-dioctylphenothiazine, P,P'-dioctyldiphenylamine, N,N'-diisopropyl-p-phenylenediamine, and N,N'-di-sec-butyl-p-phenylenediamine; and phenol-based compounds, such as 2,6-di-tert-dibutylphenol and hindered phenols, such as hindered, ester-substituted phenols.

Representative metal inactivators include, but are not limited to, benzotriazole, benzimidazole, 2-alkyldithiobenzimidazoles, 2-alkyldithio-benzothiazoles, 2-(N,N-dialkyldithiocarbamoyl)benzothiazoles, 2,5-bis(alkyl-dithio)-1,3,4-thiadiazoles, and 2,5-bis(N,N-dialkyldithiocarbamoyl)-1,3,4-thiadiazoles.

The thickener can comprise any material that, in combination with the neopolyol ester, will produce a semi-fluid or solid structure. Representative thickeners include soaps of aluminum, lithium, barium, sodium, calcium, mixtures thereof, silicas, clays, TEFLON® fluoropolymers, polyethylene, and mixtures thereof.

Representative anti-wear agents include, but are not limited to, tricresyl phosphate, dithiophosphates, metal stearates, zinc oxide, borax, ammonium molybdate, calcium carbonate, and mixtures thereof.

Representative extreme pressure agents include, but are not limited to, graphite, triphenyl phosphorothionate, chlorinated paraffins, dithio-carbonates, fatty oils, phosphate additives of fatty acids or fatty acid esters, sulfurized fatty oils, fatty acids, or fatty acid esters, molybdenum disulfide, tungsten disulfide, phosphate esters, phosphorous-sulfur containing compounds, and mixtures thereof. The additives are used in such amounts so as to provide their normal attendant functions, typically in the range of between about 0.01 to about 10.0 wt. % each, based on the total weight of the composition.

The lubricant compositions of this invention are made by mixing the boric acid, the organic liquid, and the surfactant in a high shear blender until a homogeneous mixture is obtained. Optionally, at this time, other conventional lubricant additives can be added. Generally, the ingredients are blended at a temperature of about 150° F. However, the blending can also be done also at higher and lower temperatures, with higher temperatures being preferred to lower temperatures, because of the ease of forming the homogeneous solution. The mixture is then slowly cooled to room temperature.

To this mixture is slowly added the lubricant, either in an amount to form a concentrate or to form the lubricant composition. During the addition and, preferably, for a time after, the multiphase composition is mixed with a high shear blender until a stable emulsion is formed.

Both the concentrate and the finished lubricant compositions remain stable, even when subjected to a variety of potentially destabilizing conditions. For example, the boric acid remains in the emulsion at temperatures ranging from about −30° F. to 150° F. and the emulsion is shelf stable for one to two years. Moreover, the finished lubricant compositions provide superior lubricity and reduced wear on mechanical components, while preventing corrosion.

While various embodiments of the present invention have been described above, it should be understood that they have been presented by way of example only, and not limitation. It will be understood by those skilled in the art that various changes in form and details can be made therein without departing from the spirit and scope of the invention as defined in the appended claims. Thus, the breadth and scope of the present invention should not be limited by any of the above-described exemplary embodiments, but should be defined only in accordance with the following claims and their equivalents.

I claim:

1. A multiphase lubricant composition comprising: an emulsion comprising (a) a first phase comprised of a lubricant comprising an engine oil, gear oil, synthetic oil, silicon oil, hydraulic fluid, transmission fluid, cutting oil, or grease;

(b) a second phase comprised of (i) boric acid;

(ii) glycerol; and, (c) a surfactant.

2. The multiphase lubricant composition in accordance with claim 1, wherein the concentration of the first phase is from about 30 to about 70 wt. %, and the concentration of the second phase is from about 30 to about 70 wt. %, based on the weight of the lubricant composition.

3. The multiphase lubricant composition in accordance with claim 1, wherein the concentration of the first phase is from about 45 to about 55 wt. %, and the concentration of the second phase is from about 45 to about 55 wt. %, based on the weight of the lubricant composition.

4. The multiphase lubricant composition in accordance with claim 1, wherein the second phase contains from about 10 to about 25 wt. %, boric acid and from about 90 to about 75 wt. %, glycerol, based on the weight of the second phase.

5. The multiphase lubricant composition in accordance with claim 1, wherein the lubricant comprises a hydraulic fluid, or a transmission fluid.

6. The multiphase lubricant composition according to claim 1, wherein the boric acid has a particle size of less than 65 microns.

7. The multiphase lubricant composition according to claim 1, wherein the boric acid has a particle size of about 0.1 to about 2.5 microns.

8. The multiphase lubricant composition according to claim 1, wherein the boric acid has a particle size of about 0.5 to about 1 micron.

9. The multiphase lubricant composition according to claim 1, wherein the boric acid remains in the emulsion at temperatures ranging from −30° F. to 150° C.

10. The multiphase lubricant composition according to claim 1, comprising about 0.5 to about 1.5 wt. % of surfactant, based on the weight of the lubricant composition.

11. The multiphase lubricant composition according to claim 1, wherein the surfactant is selected from the group consisting of tristyrylphenol ethoxylates, EO/PO/EO block copolymers, sodium salts of sulfonated naphthalenesulfonic acid-formaldehyde condensation products, lignosulfonates, PO/EO butanol copolymers, block copolymers of polyhydroxystearic acid and polyalkylene glycols, and partially hydrolysed or fully hydrolysed polyvinyl acetate.

12. The multiphase lubricant composition according to claim 1, wherein the lubricant comprises an engine oil.

13. The multiphase lubricant composition according to claim 1, wherein the boric acid has a particle size of 65 microns to 100 microns.

14. The multiphase lubricant composition according to claim 1, wherein the concentration of boric acid is from about 5 wt. % to about 17.5 wt. %, based on the weight of the lubricant composition.

15. The multiphase lubricant composition according to claim 1, wherein the concentration of boric acid is from about 1 wt. % to about 50 wt. %, based on the weight of the lubricant composition.

16. The multiphase lubricant composition according to claim 1, wherein the concentration of boric acid is from about 15 wt. % to about 50 wt. %, based on the weight of the lubricant composition.

17. The multiphase lubricant composition according to claim 1, wherein the lubricant comprises silicon oil.

18. The multiphase lubricant composition according to claim 1, wherein the lubricant comprises a cutting oil.

19. The multiphase lubricant composition according to claim 1, comprising 22.5 to 63 wt. % glycerol based on the weight of the lubricant composition.

20. A method of using the multiphase lubricant composition comprising using the lubricant composition of claim 1, in a hydraulic environment.

21. A method of using the multiphase lubricant composition comprising using the lubricant composition of claim 1, in a cutting environment.

22. A multiphase lubricant composition comprising:

an emulsion comprising (a) a first phase comprising a grease;

(b) a second phase comprising (i) boric acid;

(ii) an organic liquid that is a solvent for boric acid, but immiscible in the first phase; and (c) a surfactant, wherein the concentration of boric acid is from about 20 wt. % to about 50 wt. %, based on the weight of the lubricant composition.

23. The multiphase lubricant composition in accordance with claim 22, wherein the organic liquid comprises glycerol.

* * * * *